US006705824B2

(12) United States Patent
Ablabutyan et al.

(10) Patent No.: US 6,705,824 B2
(45) **Date of Patent: *Mar. 16, 2004**

(54) WHEELCHAIR LIFT DEVICE

(75) Inventors: Karapet Ablabutyan, Glendale, CA (US); Parkev Krmoian, Glendale, CA (US)

(73) Assignee: Maxon Lift Corporation, Cerritos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/251,433

(22) Filed: Sep. 20, 2002

(65) Prior Publication Data

US 2003/0095856 A1 May 22, 2003

Related U.S. Application Data

(63) Continuation of application No. 09/675,318, filed on Sep. 29, 2000, now Pat. No. 6,461,097.

(51) Int. Cl.[7] ..... A61G 3/08
(52) U.S. Cl. ..... 414/546; 414/921
(58) Field of Search ..... 414/546, 921

(56) References Cited

U.S. PATENT DOCUMENTS 6,238,169 B1 * 5/2001 Dupuy et al. ..... 414/546
6,461,097 B1 * 10/2002 Ablabutyan et al. ..... 414/546

FOREIGN PATENT DOCUMENTS

EP 955029 * 11/1999

* cited by examiner

*Primary Examiner*—Steven A. Bratlie
(74) *Attorney, Agent, or Firm*—Manatt, Phelps & Phillips, LLP

(57) ABSTRACT

A wheelchair lift for supporting a wheelchair bound passenger and for moving the passenger between ground level and an opening in a vehicle. The wheelchair lift includes a platform and pivotal mechanism engaging the platform as well as a bridge plate for assuming a horizontal orientation to enable the passenger to proceed through the vehicle opening and a vertical orientation to act as a roll stop as the platform proceeds between the ground and the vehicle opening. The bridge plate includes a non-linear channel configured within its side which engages a pivotal mechanism which includes an upper parallelogram structure and hydraulic apparatus to move the upper parallelogram structure to move the platform. Also included is a lower parallelogram structure which is in sliding engagement with the upper parallelogram structure during at least a portion of the motion when the platform is moved between the ground and the vehicle opening. The lower parallelogram also is provided with a saddle bolt for sliding engagement with the non-linear channel such that movement of the lower parallelogram acts to raise and lower the bridge plate upon movement of the platform.

4 Claims, 5 Drawing Sheets

WHEELCHAIR LIFT DEVICE

This application is a continuation of U.S. patent application Ser. No. 09/675,318 filed on Sep. 29, 2000 and issued as U.S. Pat. No. 6,461,097 on Oct. 8, 2002.

FIELD OF INVENTION

The present invention is directed to a wheelchair lift apparatus of the type appended to and supported by a vehicle. The invention enables a wheelchair bound passenger at ground level to enter and be supported by a platform which, upon actuation, lifts the wheelchair bound passenger into a vehicle opening in a safe and efficient manner. A unique configuration is provided for actuating a bridge plate/roll stop which acts to prevent the wheelchair from rolling from the platform during the lift operation and further acts as a bridge between the platform and the vehicle interior once it is safe for the passenger to exit the platform and enter the vehicle.

BACKGROUND OF THE INVENTION

There has been a plethora of art dealing with the transport of wheelchair bound handicapped persons. Some of these devices are self supporting and can be rolled or otherwise pushed against a vehicle opening. Other such devices are appended to the bottom of a vehicle chassis while others are supported at or about the sidewall of the vehicle proximate the vehicle opening. All of these various configurations can benefit by the employment of the present invention. The invention, however, will be described by making reference to the latter embodiment for convenience.

Devices of this kind all must be provided with certain general design components dictated principally by the need to capture and lift the wheelchair bound passenger in a safe fashion as well as to enable the device to fold or somehow be made unobtrusive when not in use. Devices of this kind are generally shown in a series of patents assigned to Ricon Corp. typified by U.S. Pat. No. 5,605,431 issued on Feb. 25, 1997, the disclosure of which is incorporated by reference herein.

Specifically, wheelchair lift devices of the type disclosed in the '431 patent include a mobile platform for receiving a wheelchair, a parallelogram mechanism for carrying the platform, a hydraulic system for actuating the platform through the parallelogram mechanism and a control unit to accomplish different motion patterns. The parallelogram structure enables the platform to proceed between ground level and a vehicle opening while maintaining a horizontal orientation for supporting the wheelchair bound passenger. This structure also provides for a storage orientation enabling the platform to swing in a ninety degree arc to assume a substantially vertical orientation once the passenger is on board to enable the vehicle to proceed in a normal fashion.

The parallelogram structure, in actuality, includes a pair of such structures, one being located on each side of the platform. Upon hydraulic actuation, these parallelogram structures can open or fold in order to carry out the motion patterns as noted above. There is also generally employed a second or lower parallelogram structure which is in sliding engagement with the upper parallelogram structure which facilitates stowage and other platform actuation orientations. Again, as noted, the details of these various structures are taught in a series of patents typified by U.S. Pat. No. 5,605,431. As such, no attempt will be made herein to discuss the details of these configurations.

In order to address certain safety concerns dictated not only by logic but also government mandate, it is necessary to provide roll stops on both the front and rear edges of the lift platform in order to prevent inadvertent egress from the platform during the lift operation. It is quite apparent from reviewing prior configurations of this kind that these roll stops must also be capable of rotating through an arc of travel to enable a wheelchair bound passenger to enter and exit the platform at appropriate locations. Specifically, the outer roll stop must rotate counterclockwise from a substantially vertical to substantially horizontal orientation acting as a ramp at ground level to enable a wheelchair bound passenger to be rolled on to the platform. At this instant, however, the inward roll stop must be at a substantially vertical orientation to prevent the wheelchair bound passenger from inadvertently traveling off of the platform and its inner edge.

As the hydraulics are actuated resulting in a lifting of the platform, both the outer and inner roll stops maintain a substantially vertical orientation thus capturing the wheelchair bound passenger on the platform. Once the platform reaches the vehicle entrance, the outer roll stop maintains its substantially vertical orientation but the inner roll stop must then travel in a clockwise arc to act as a bridge plate between the platform and the vehicle interior. This enables the wheelchair bound passenger to enter the vehicle for later transport.

The present invention has recognized a need to improve upon the way in which the inner roll stop is actuated to change its orientation as described. Specifically, devices of this kind have provided various cam and cable mechanisms to enable the inner roll stop to move from a blocking (vertical) orientation to a transporting (horizontal) orientation simultaneously as the wheelchair reaches the vehicle opening without human intervention. Likewise, as the wheelchair supporting platform is lowered from the vehicle opening towards ground level, this rather complex configuration of the prior art acts to simultaneously move the inner roll stop to a blocking orientation. This is an important feature for it does not require an operator to change the orientation of the roll stop for, to do so, may result in an inadvertent accident as the operator may on occasion forget to change the position of the inner roll stop due to mere human error or omission.

It is thus an object of the present invention to provide a mechanism for changing the orientation of an inner roll stop without the need for complex camming and cabling as is so often employed in the prior art. This and further objects of the present invention will be more readily apparent when considering the following disclosure and appended claims.

SUMMARY OF THE INVENTION

An advantage of the present invention involves an inner roll stop mechanism usable with a wheelchair lift having a platform movable between a raised position and a lowered position. The inner roll stop mechanism comprises a pivotal mechanism engaging said platform and a bridge plate for assuming a substantially horizontal orientation and a substantially vertical orientation as the platform proceeds between the raised position and the lowered position.

DETAILED DESCRIPTION OF THE INVENTION

Wheelchair lift apparatus 10 includes lift platform 11 upon which a passenger bound wheelchair is intended to reside during normal operation of this device. The apparatus further generally includes a pair of handrails 12, one on each side of platform 11 acting as safety barriers which can also include some type of safety belt or harness (not shown).

Figure 1:
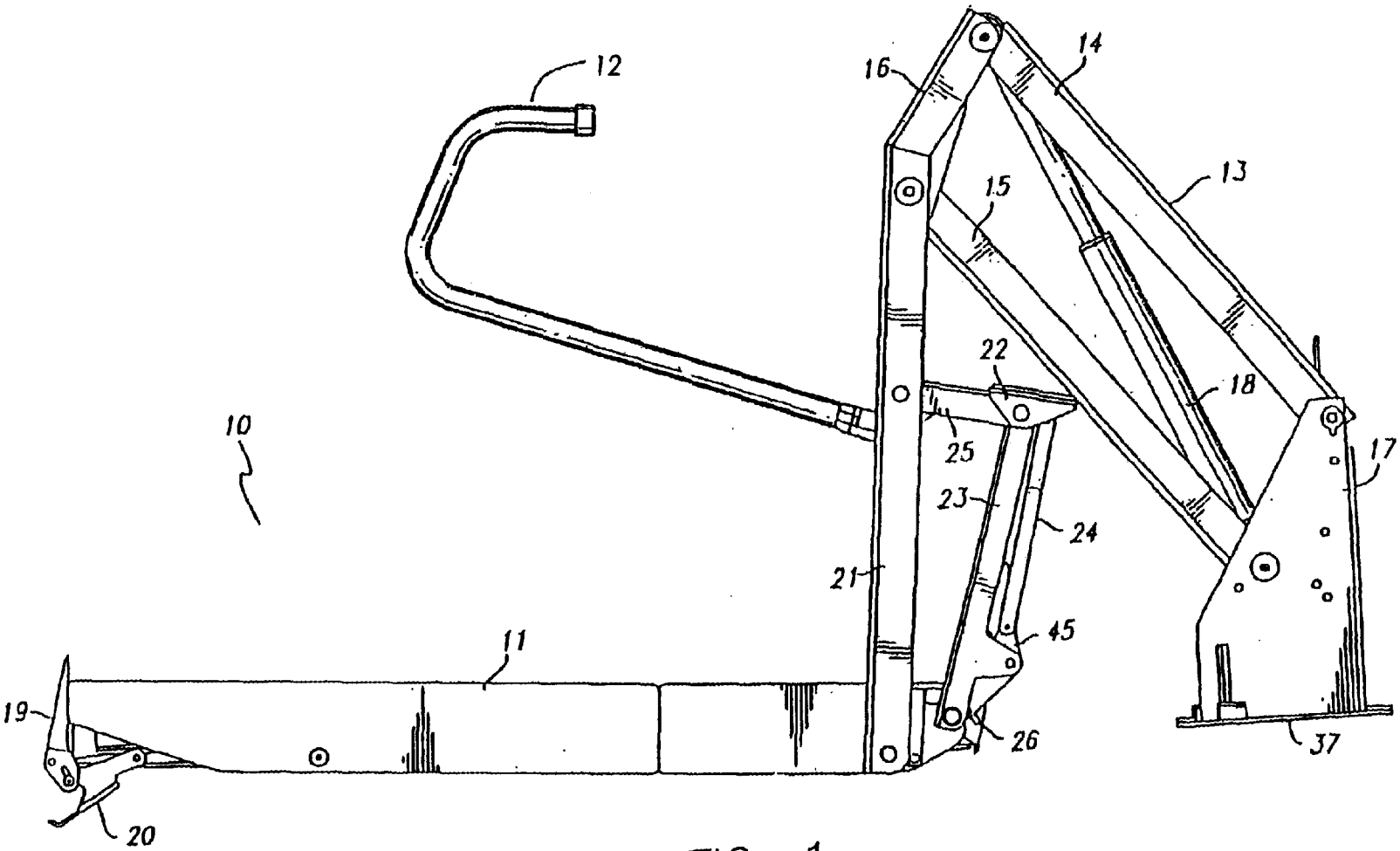
FIGS. 1 through 5 depict various plan views of the present invention during a cycle in which the present invention approaches a vehicle opening and is then stowed.

The lift apparatus of FIG. 1 is generally shown in an orientation as it approaches the opening of a vehicle. Support plate 17 is supported by the vehicle (not shown) whereby bottom plate 37 is bolted or otherwise fixedly joined to a vehicle support member for ridged attachment.

In operation, upper parallelogram 13 is actuated by hydraulic cylinder 18 which, in turn, is operated in conjunction with a suitable pump and electromechanical actuators (not shown), all of which is well known in this art.

DETAILED DESCRIPTION OF VARIOUS EMBODIMENTS

In the orientation shown in the various figures, upper parallelogram members 14, 15 and 16 together with support plate 17 maintain platform 11 in a substantially horizontal orientation as shown. In that this platform is intended to capture and maintain a wheelchair bound passenger, outer roll stop 19 which is spring biased in a substantially vertical orientation acts to prevent the wheelchair from inadvertently traveling over the outer edge of platform 11. When platform 11 reaches ground level, plate 20 will contact the ground causing outer roll stop 19 into a substantially horizontal orientation acting as a ramp to enable entry and egress to and from platform 11.

Figure 2:
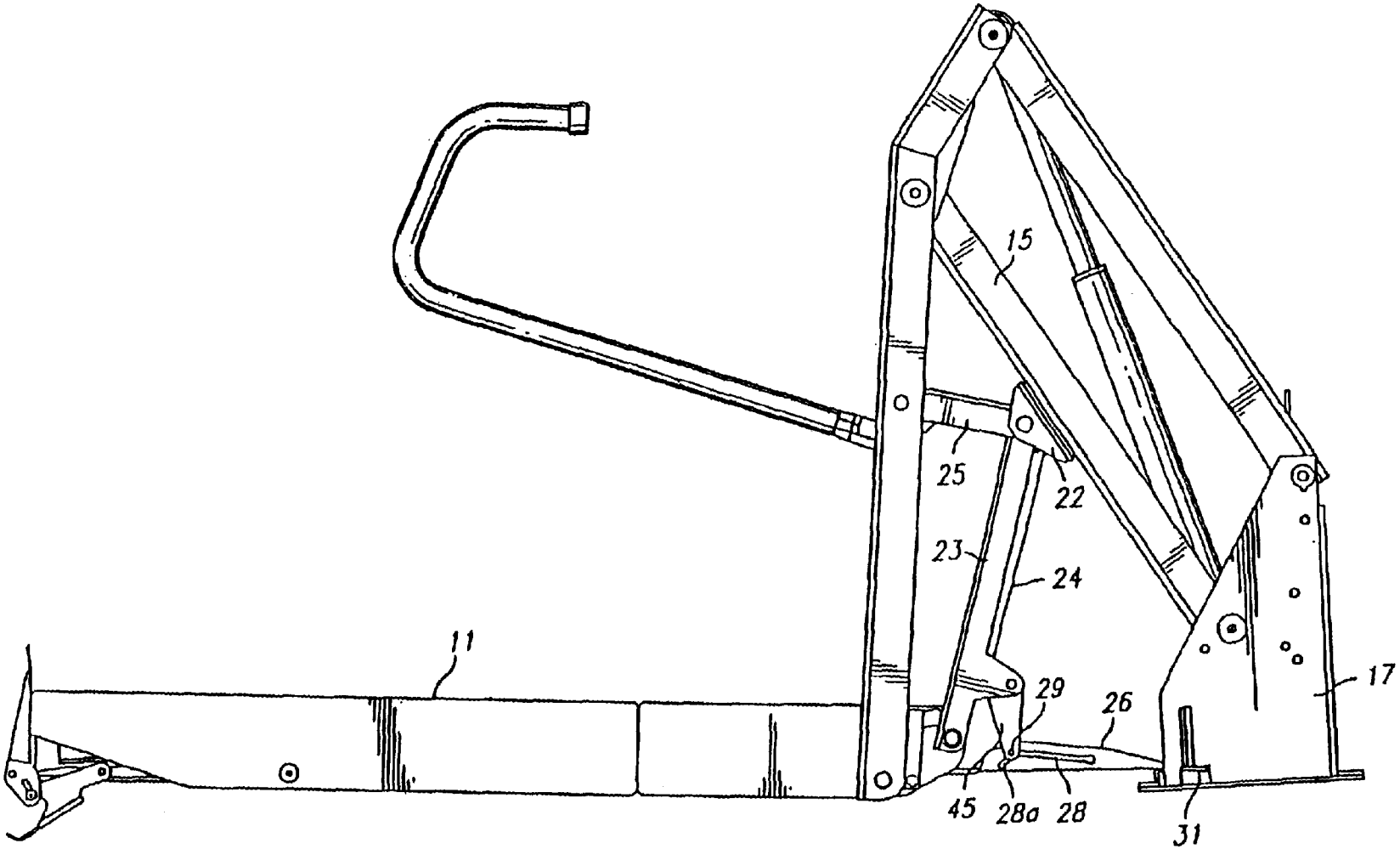
Figure 3:
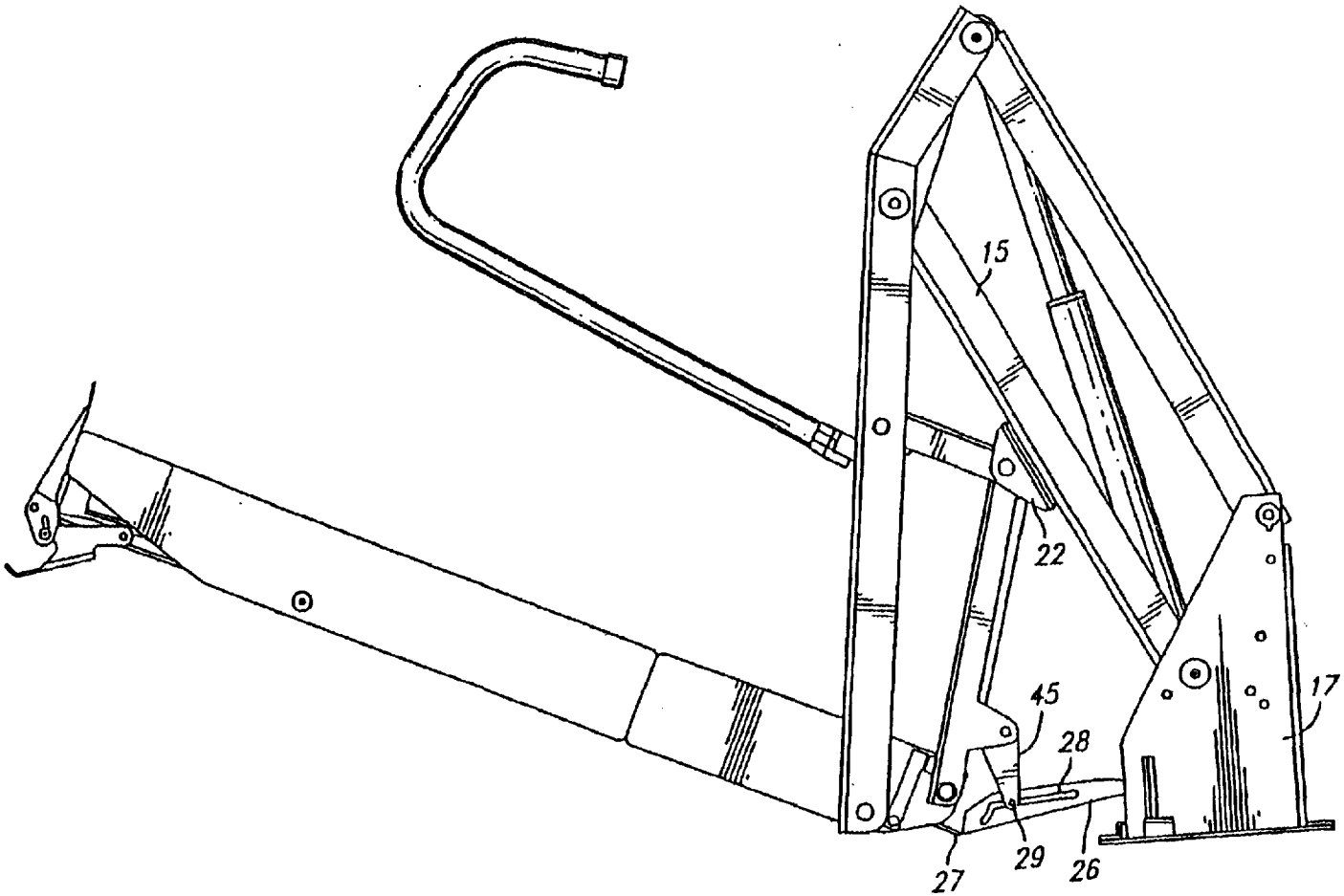

As noted, at the orientation shown in FIG. 1, inner roll stop 26 is illustrated as assuming a substantially vertical orientation to again prevent inadvertent progression of the wheelchair bound passenger from platform 11. However, as platform 11 reaches the vehicle doorway, inner roll stop 26 assumes a substantially horizontal orientation (FIG. 2) without the need for complex camming or cabling as is commonly employed by the prior art. Specifically, in comparing FIGS. 1 and 2, lower parallelogram structure made up of elements 23, 24, 25 and 45 is impacted as contact block 22 enters into sliding engagement with the lower surface of parallelogram arm 15.

As was the case with outer roll stop 19, inner roll stop 26 is spring biased to assume a vertical orientation, the spring being configured within hinge 27. It is noted that the lower parallelogram structure includes pivotable swing arm 45 which changes orientation as contact block 22 moves in response to a change in orientation of upper parallelogram arm 15. Pivotable swing arm 45 includes saddle bolt 29 which is designed to travel within non-linear channel 28 configured within the side of inner bridge plate 26. When assuming the horizontal orientation shown in FIG. 2, saddle bolt 29 is oriented to reside within curved section 28*a* of non-linear channel 28 which acts as a locking or securing means to maintain the horizontal orientation of inner bridge plate 26. During this orientation, inner bridge plate 26 resides upon surface 31 as the floor to the transport vehicle.

Figure 4:
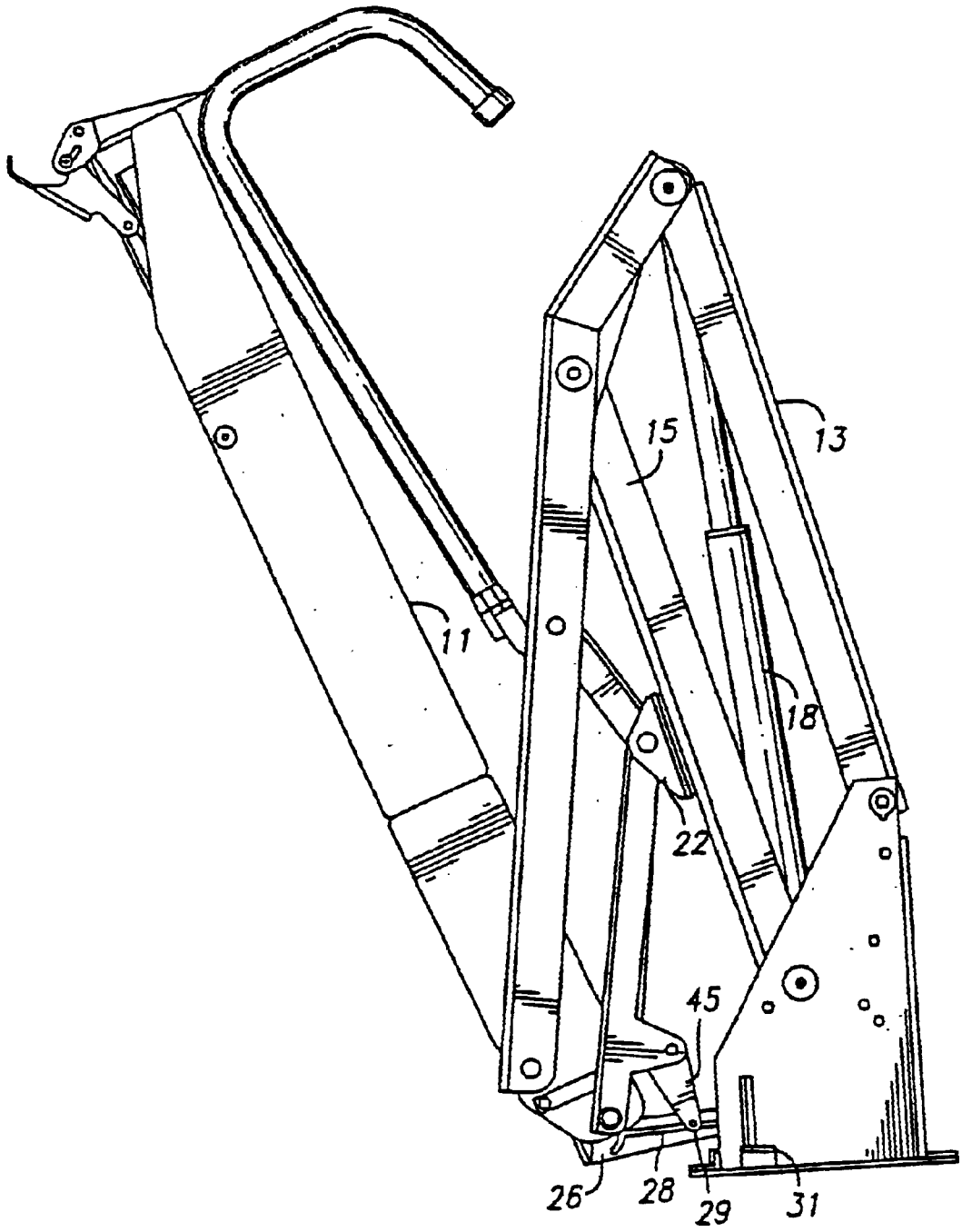

FIG. 4 depicts the orientation of the present invention as it begins to fold for stowage. It is noted that hydraulic cylinder 18 further extends causing upper parallelogram structure 13 to approach a vertical orientation. Contact block 22 continues to slide along parallelogram arm 15 thus causing saddle bolt 29 of pivotable swing arm 45 to travel along non-linear channel 28. This further causes inner bridge plate 26 to begin rising from surface 31 and approaches a perpendicular orientation to platform 11 which, itself, proceeds to assume the vertical orientation shown in FIG. 5.

Figure 5:
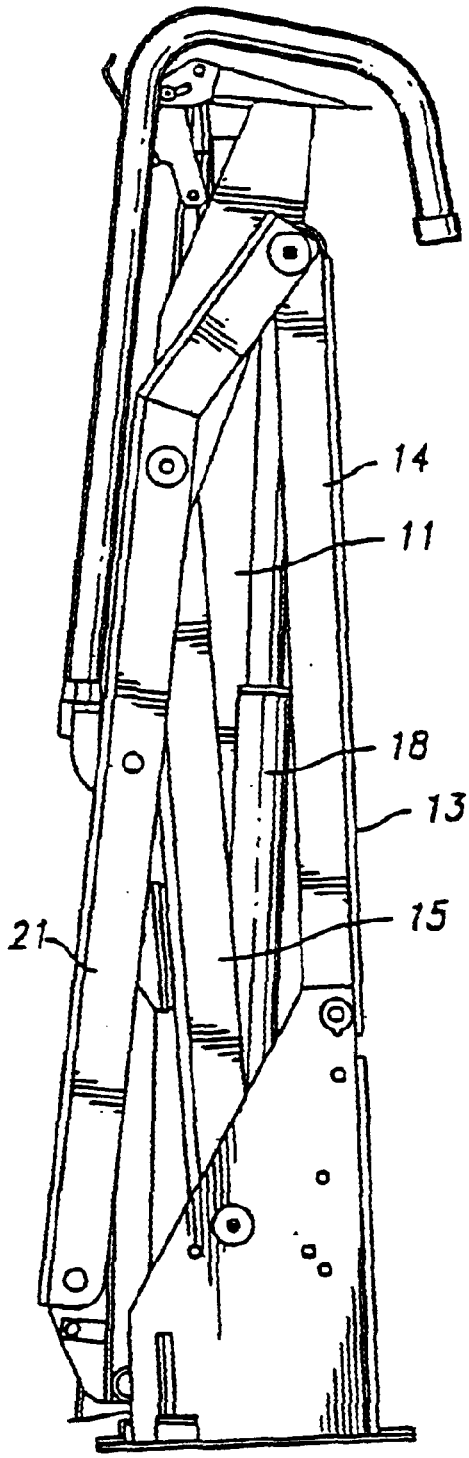

FIG. 5 shows the wheelchair lift apparatus of the present invention in a stowed configuration. Support arm 21 and platform 11 are substantially vertical as are the upper and lower arms 14 and 15 of upper parallelogram 13. Hydraulic cylinder 18 is fully extended while the bridge plate (not shown) is tucked against support platform 11.

What has now been depicted as the present invention is a simplified means of orienting inner bridge plate 26 through the use of a simple linkage and without the need for complex camming or cabling. As in prior configurations, inner bridge plate 26 can assume a blocking or bridging orientation and will do so automatically and without human intervention. Further, in light of the use of non-linear channel 28 and particularly curved section 28*a*, bridge plate 26 will assume a substantially horizontal orientation against a biasing spring contained within hinge 27 until the orientation of platform 11 is substantially changed.

While various embodiments of the present invention have been described with reference to the drawings, these are not intended to limit the scope of the present invention, which is set forth in the appending claims. Various modifications of the above described embodiments can be made by those skilled in the art after browsing the specification of the subject application. These modifications are within the scope and true spirit of the present invention.

What is claimed is:

1. An inner roll stop mechanism usable with a wheelchair lift having a platform movable between a raised position and a lowered position, comprising:

a bridge plate attached to said platform and having a channel; and a pivotal mechanism slideably attached to said bridge plate through said channel, said pivotal mechanism causing said bridge plate to rotate from a substantially vertical orientation to a substantially horizontal orientation in response to the platform moving from the lowered position to the raised position.

2. The inner roll stop mechanism of claim 1, wherein said pivotal mechanism includes a saddle bolt slideably mated with said channel.

3. The inner roll stop mechanism of claim 1, further comprising a spring coupled to said bridge plate and to said platform and urging said bridge plate to assume the substantially vertical orientation.

4. The inner roll stop mechanism of claim 1, wherein said pivotal mechanism includes:

an upper parallelogram structure coupled to said platform;

a hydraulic apparatus coupled to said upper parallelogram structure; and a lower parallelogram structure in sliding engagement with said upper parallelogram structure.

* * * * *